United States Patent [19]

Kawamata et al.

[11] Patent Number: 4,533,064

[45] Date of Patent: Aug. 6, 1985

[54] CAN AND CLOSURE STRUCTURE

[75] Inventors: Kiyoshi Kawamata; Seizi Kawamata, both of Ohomiya, Japan

[73] Assignee: Nihon Seikan Kabushiki Kaisha, Ohomiya, Japan

[21] Appl. No.: 644,675

[22] Filed: Aug. 27, 1984

[51] Int. Cl.[3] ..... B65D 17/46

[52] U.S. Cl. ..... 220/273; 220/258

[58] Field of Search ..... 220/258, 269–273

[56] References Cited

U.S. PATENT DOCUMENTS 3,383,008 5/1968 Lipske ..... 220/270

3,554,369 1/1971 Paschke ..... 220/270

*Primary Examiner*—George T. Hall

*Attorney, Agent, or Firm*—Wenderoth, Lind & Ponack

[57] ABSTRACT

A can or similar container usually equipped with a removable top cover includes a thin-foil partition that is detachably mounted over the open top of the can body, the thin-foil partition carrying a peripheral score or cut line and a straight score or cut line defining a semi-circular dispensing opening area, and a finger grip which allows the partition to be detached along the two score lines to provide a semi-circular dispensing opening. The partition is made of a thin film material, and includes a rivet-like hollow bulge integrally formed thereon, which is backed by a reinforcing filler member inside to solidify the hollow bulge. The finger grip is solidly secured to an appropriate position of the partition by means of the reinforced bulge, and pulling it up with a finger causes the semi-circular dispensing opening area of the partition to be detached apart from the can body. The straight-line cut edge left after the removal of the opening area serves as a scraper edge for smoothing the excess on a spoon.

4 Claims, 23 Drawing Figures

CAN AND CLOSURE STRUCTURE

BACKGROUND OF THE INVENTION

1. Field of the Invention

The present invention relates generally to a can or similar container construcion, and more particularly to a can closure construcion that includes a thin-film sealing intermediate partition detachably mounted over the open top of the can body and carrying a semi-circular score or cut lines defining a dispensing opening area and a finger grip secured thereto that allows the defined opening area of the partition to be detached apart from the can body by simply pulling it up with a finger.

2. Description of the Prior Art

A can or similar container construction of the kind including a detachable thin-foil partition at the open top carrying score or cut lines along which the partition is to be detached by pulling up a finger grip which is also secured to the partition is already known, and is actually used for containing powdered milk, for example.

The conventional can is usually equipped with a removable top cover or lid, and when it is desired to open the can, the top cover is first removed, and then the thin-foil partition is detached along the score lines. This is usually accomplished by pulling the finger grip up in an attempt to force the dispensing opening area of the partition to be detached apart from the can body along the score lines. After removal of the dispensing opening area defined by the score lines, an opening is left in the top of the can body, which is configured to conform to the dispensing opening area as detached. Through the opening, the contents can be taken out of the can. For subsequent reuse of the can, the top cover is recapped and removed.

The partition used with the above prior-art can construction is usually made of a transparent or nontransparent thin synthetic resin film or metal foil. It carries a finger grip, which is firmly secured to the surface of the partition material by employing a welding or bonding method. As an alternative, a rivetting or caulking method is employed, or a bulged portion is integrally formed on the surface of the partition itself. In this alternative method, the rivet or bulged portion provides a means of securing the finger grip to the partition. It should be noted, however, that in all cases the film or foil material is inherently thin, and provides a relatively less rigidity. For this reason, it has been observed that securing the finger grip to the film or foil forming the partition is so unreliable that any attempt to raise the finger grip to detach the partition is likely to cause the finger grip physically to be detached from the film base. This means that the finger grip would lose the ability to detach the partition apart from the can body, resulting in the need of using an alternative detaching means. Then, the scraping function intended by the present invention could not be provided.

SUMMARY OF THE INVENTION

In order to overcome the problems and disadvantages presented by the above-cited prior art can constructions, a principal object of the present invention is to provide an improved can or similar container construciton that includes means of securing a finger grip solidly to the thin-foil partition base, which is detachably mounted over the open top of the can body. Thus, removal of the dispensing opening area of the partition defined by the score or cut lines is facilitated by simply pulling the finger grip up, without any accompanying effect of causing the finger grip to be detached from the partition base.

Briefly described, the can construction according to the present invention achieves the above object in the following manner. The can construction comprises a cylindrical can body usually capped by a removable top cover at the open top. It includes an intermediate thin-foil partition that provides the function of sealing the interior of the can body prior to its actual use. The partition is made of a thin plastic film or metal foil, and is stretched and detachably mounted over the open top. It carries a semi-circular score or cut line running along the peripheral edge of the open top of the can body and a straight score or cut line running across the partition between the opposite ends of the semi-circular score line. Those score lines define the dispensing opening area of the partition, and removal of that area leaves the can body open, which configuratively conforms to the shape of the area. A finger grip is also carried by the partition to allow that area of the partition defined by the score lines to be detached apart from the can body. Specific features of the finger grip include a mounting hole, into which a hollow bulge or protrusion integrally formed on the partition is accommodated, thereby securing the finger grip solidly to the partition. To secure the solidity of the finger grip to the partition, the hollow bulge is backed by a reinforcing filler or packing member inside. The filler member may take two different forms, one being solid and the other being internally hollow. The choice may be made as appropriate. In either case, the connection between the finger grip and the partition is reinforced by the backing filler member inside the hollow bulged portion. Thus, any attempt to pull the finger grip up with a strength enough to detach the partition from the can body causes the opening area of the partition to be detached together with the finger grip. The filler member may include synthetic resin, soft metal, and other similar substances.

BRIEF DESCRIPTION OF THE DRAWINGS

Those and other objects and features of the present invention will be made apparent from the description of the specific preferred embodiments that follows in connection with the accompanying drawings, in which.

Figure 1:
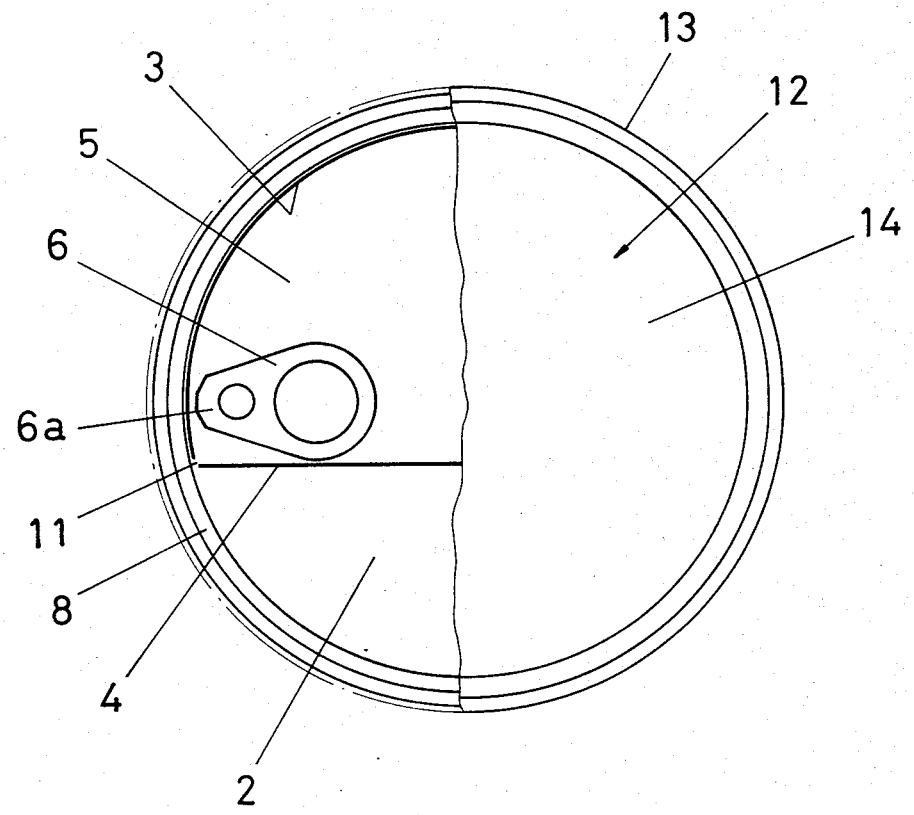
FIG. 1 is a plan view of a typical preferred embodiment of the present invention, as partly broken away.
Figure 2:
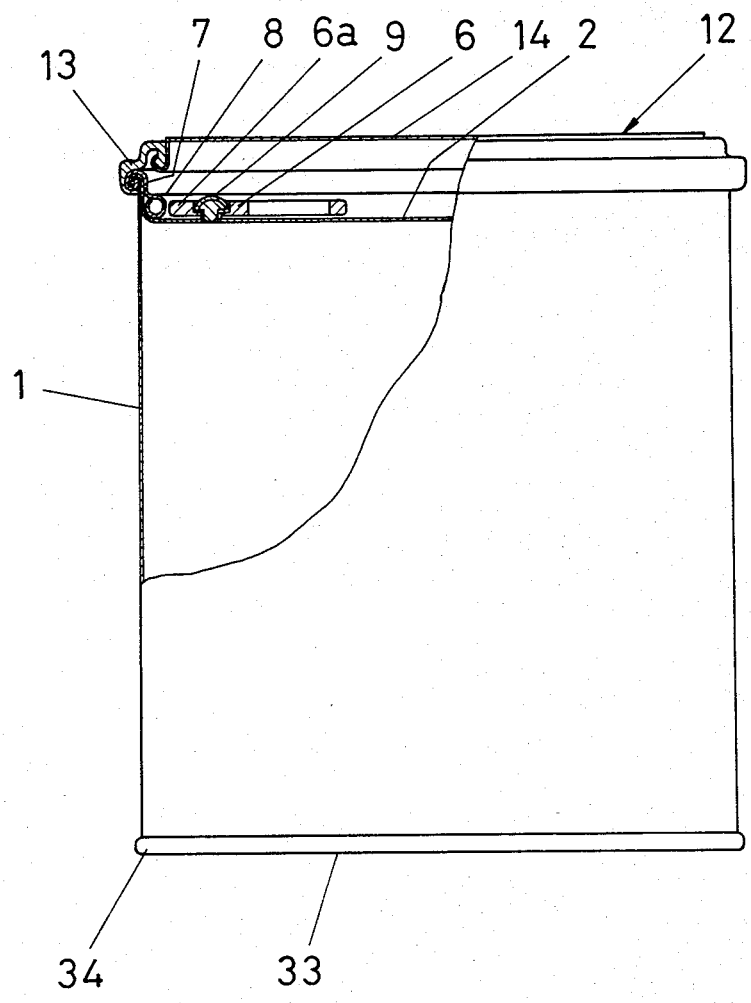
FIG. 2 is a front view of the same embodiment, as partly broken away.
Figure 3:
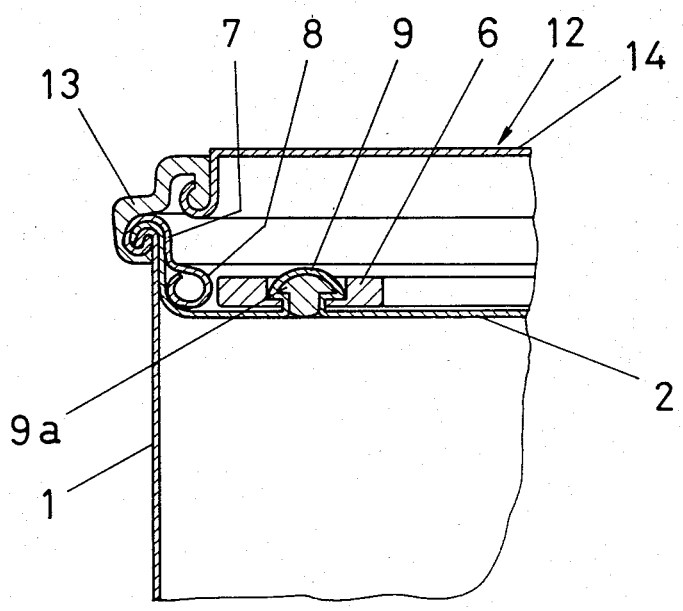
FIG. 3 is a partly enlarged sectional view of the same embodiment.

The can construction shown in FIGS. 1 through 3 comprises a can body 1 open at the top, over which an intermediate partition 2 made of a synthetic resin film is detachably mounted. More specifically, the partition 2 carries a score or cut line 3 running along the peripheral edge of the open top of the can body 1, the score or cut line 3 being formed in a semi-circular track or groove with the opposite ends being terminated as break points (non-score areas) 11. A straight score or cut line 4 in the form of a groove is also provided on the partition, running across the partition between the terminated ends 11 of the semi-circular score line 3. As shown, the opposite ends of the straight score line 4 remain to be disconnected from the corresponding ends of the semi-circular score line, that is, separated from each other by the non-score areas 11. The two score lines 3 and 4 define a dispensing opening area 5 of the partition, which provides a dispensing opening whose configuration conforms to the shape of the dispensing opening area 5, which is to be detached from the can body 1 along the score lines 3 and 4. After the dispensing opening area 5 of the partition is completely removed, the edge of the remaining part of the partition along the score line 4 serves as a scraper that allows any excess in a spoon to be smoothed. The dispensing opening area 5 carries a finger grip 6 which consists of a mounting side 6*a* equipped with a hole and a finger gripped side. The finger grip 6 is solidly secured to the dispensing opening area 5 of the partition 2, with the mounting side 6*a* of the finger grip located adjacent the semi-circular score line 3 and the finger grip as a whole located adjacent the straight score line 4 and longitudinally in parallel with the same.

The synthetic resin film forming the partition 2 has a circular shape conforming to the shape of the open top of the can body 1, and the peripheral marginal edge is sandwiched between the inner wall of the can body 1 and the outer wall of a metallic ring 7 which is fitted inside the open top. The metallic ring 7 is configured to include an annular portion 8 of substantially circular cross-section at the bottom, which is deformably shaped to be hollow through the longitudinal direction thereof. The annular portion 8 of the metallic ring 7 is pressed toward the surrounding can wall so that it is placed under deformation. Thus, the partition film 2 is tensioned in a radial direction toward the can body wall, and is placed under uniform tension over the surface.

The specific steps of having the film base 2 stretched over the open top as described above are as follows. A first step is to place the film base 2 shaped like a dish having a marginal flange and the metallic ring 7 all together inside the open top of the can body 1. Then, the overlapped portions of the three elements, that is the can body 1, synthetic resin film 2 and metallic ring 7 are seamed together by employing the usual curling method. As seamed together, the bottom annular portion 8 of the metallic ring 7 has the underside engaging the surface of the film base 2. Then, when a mechanical force is applied to the annular portion 8 of the metallic ring 7 in the direction of pressing it toward the can body wall and subjecting it to deformation, the marginal edge of the film base 2 engaging the annular portion 8 is pulled in the same direction, placing the total area of the film base under tension. Thus, the partition 2 is tautly stretched over the open top of the can body 1.

The metallic ring 7 may have a varied configuration having no annular portion 8 at the bottom. In its variation, the metallic ring 7 may be equipped with an outwardly bent portion at the bottom, which is formed by expanding the bottom of the annular metallic ring slightly toward the can body wall. An annular recessed portion is provided on the inner side of the can body wall to accommodate the above outwardly expanded portion of the metallic ring. Expanding the bottom of the metallic ring in this manner causes a pressure to be applied to the partition film toward the can body wall, placing it under tension. Thus, the film is tautly stretched over the open top. In addition to the mechanical application of pressure as described above, the thermal contraction may be relied upon to cause a stretching tension to the film base.

A hollow protrusion or bulge 9 is integrally formed on the film base partition 2, which as shown in the specific feature of the present embodiment is located on the dispensing opening area 5 delimited by the semi-circular score line 3 and the straight score line 4. As particularly shown, the hollow protrusion 9 is formed adjacent to one side of the dispensing opening area 5. A finger grip 6 to be mounted to the hollow protrusion 9 has a mounting hole which serves as a pivotal or fulcrum point when an attempt is made to open the can. The mounting hole is internally formed to provide an annular stepped portion or shoulder of a smaller diameter at the bottom base, on which the hollow protrusion 9 which is to be pressed down as later described rests. The hollow protrusion 9 is reinforced by a filler or packing member which is placed inside, and is inserted into the mounting hole of the finger grip 6. FIG. 3 illustrates how the finger grip 6 is solidly secured to the film base partition 2 by means of the hollow protrusion 9. As shown, the hollow protrusion 9 is deformed to provide a rivet shape, the head of which engages the stepped portion of the mounting hole.

The following is a description of how the finger grip 6 is to be secured to the film base partition. Initially, the film base 2 is locally heated so that a hollow protrusion 9 of a substantially cylindrical profile closed at the top can be shaped on the heated region of the film base 2. Then, the hollow protrusion 9 is inserted into the mounting hole of the finger grip 6, and a ball 10 of soft metal such as aluminum is placed inside the hollow protrusion 9. A shaping press is applied to the protrusion 9 containing the filler aluminum ball 10 so that it can be shaped into a rivet head 9*a* that engages the stepped portion of the mounting hole.

The aluminum filler ball may have any shape other than the ball-like shape.

The non-score areas 11 that are present between the opposite ends of the semi-circular score line 3 and the corresponding ends of the straight score line 4 usually have a width of the range of 1 and 2 mm.

A top cover which is removably capped over the open top of the can body 1 is designated by 12, which includes a synthetic resin ring 13 and a cap-like metal plate 14 (end panel). The synthetic resin ring 13 has an annular hook on one side, to which the marginal flange of the cap-like metal plate 14 is fastened. The other side of the synthetic resin ring 13 is adapted to engage the seamed portion of the open top.

In the above described embodiment, the marginal edge of the synthetic resin film 2 forming the intermediate partition is sandwiched between the metallic ring 7 and the can body wall, and the film base partition is tautly stretched over the open top by means of the annular hollow portion at the bottom of the metallic ring 7. For opening the can, therefore, the finger grip can be raised in an attempt to detach the dispensing opening area of the partition from the can body, without causing that area to be raised together with the finger grip, that is, simply pulling the finger grip upwardly with a proper amount of force rather than with an excessive effort causes the mounting hole side of the grip to be depressed with the mounting hole acting as a fulcrum or pivotal point, applying the downward force to the dispensing opening area. When the dispensing opening area is thus depressed, a break initially occurs at the end of the semi-circular score line adjacent to the finger grip (at the same time a break in the non-score area 11 occurs). Then, lifting the finger grip 6 causes the remaining score line 3 and the straight score line 4 progressively to be broken, and finally the dispensing opening area 5 is completely detached along the score lines 3 and 4 and removed from the open top. The remaining part of the partition after removal provides an scraper edge running in a straight line across the open top of the can body. The presence of the non-score areas 11 prevents undesired break from occurring in the other areas.

The synthetic resin film material used for the partition in the above embodiment may be replaced by a metal foil.

As described in connecion with the present embodiment, the finger grip 6 is solidly secured to the partition base by means of the hollow protrusion 9 which is integrally formed to provide a portion 9*a* which engages the stepped portion of the finger grip. The hollow protrusion 9 is backed by the reinforcing filler member, which secures the fastening of the finger grip to the partition base. Therefore, there is no risk of having the finger grip physically detached from the partition base when an attempt is made to remove the dispensing opening area.

As described, the top cover 12 includes the synthetic resin ring 13 tightly closing the open top and the metal end panel 14 connected to the ring 13. The central metal end panel 14 prevents light from transmitting through the panel 14 into the interior of the can. The synthetic resin ring 13 seals the interior of the can hermetically when the top cover is recapped.

The constructional details of the finger grip 6 to be secured to the partition film base are given below .

Figure 4:
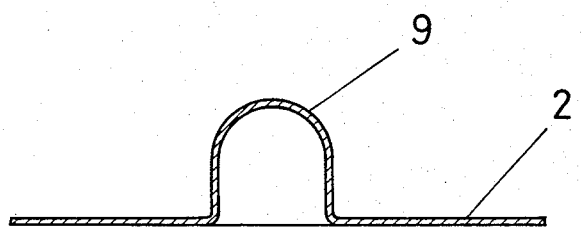
FIG. 4 is a partly enlarged sectional view of a thin-foil partition detachably to be mounted over the open top of the can body according to the embodiment in FIG. 1, illustrating how the partition is formed to include a bulged portion.
Figure 5:
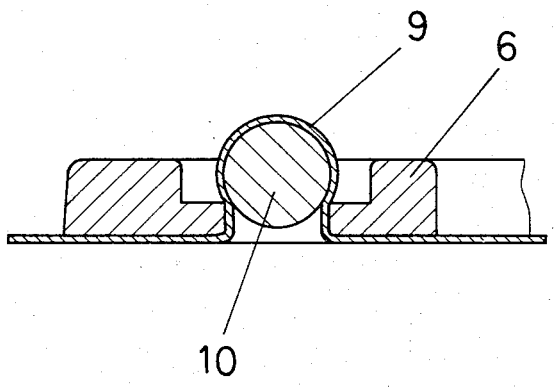
FIG. 5 is an enlarged sectional view of the partition coupled with a finger grip, illustrating how the finger grip is to be attached to the partition through the bulged portion.
Figure 6:
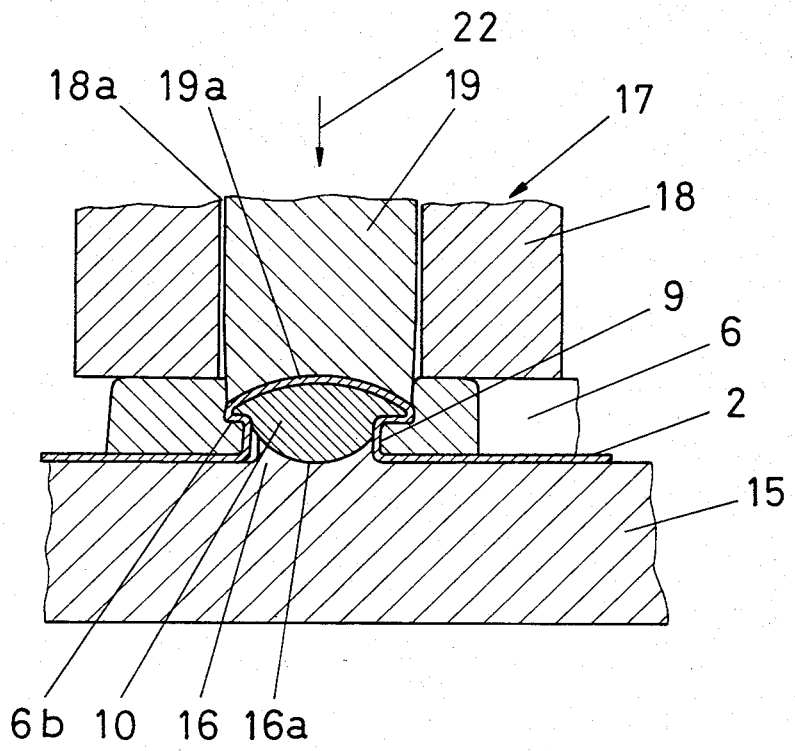
FIG. 6 is a diagram illustrating the process of attaching the finger grip to the partition by means of the appropriate press machine.
Figure 7:
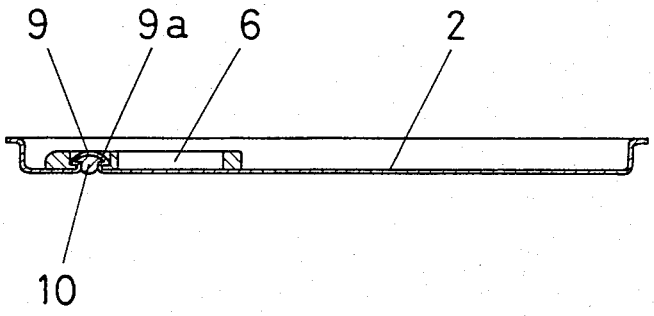
FIG. 7 is a sectional view of the partition thus coupled with the finger grip as a whole.

FIG. 4 represents the profile of the hollow protrusion or bulge 9 integrally formed on the synthetic resin film 2 (such as polypropylene, for example). As particularly shown in FIG. 5, the finger grip 6 has a mounting hole in which the hollow protrusion 9 is accommodated, the hollow protrusion 9 being backed by a reinforcing ball 10 of aluminum inside. FIG. 6 illustrates how the hollow protrusion 9 carrying the aluminum ball 10 inside is pressed into a shape that secures the finger grip 6 solidly to the partition film base 2. FIG. 6 also shows the construction of a press assembly that shapes the hollow protrusion by pressing it. The press assembly consists of a lower die 15 having a protruded portion 16 at the top and an upper die 17. The film base partition 2 is placed on the lower die 15 such that the protruded portion 16 of the lower die 15 is accommodated in the bottom of the hollow protrusion 9. The upper die 17 is placed on the hollow protrusion 9. The top of the protruded portion 16 presents an arcuately cessed surface 16*a*. The upper die 17 includes a press die 18 which holds the finger grip 6 under pressure from the above, and a shaping ram 19 which is capable of movement up and down. The press die 18 has a central bore 18*a* through which the shaping ram 19 is to be moved up and down. The shaping ram 19 is in the form of a rod which has a diameter equal to that of the upper opening of the mounting hole of the finger grip 6, and the bottom end of the rod 19 is formed to present an arcuately recessed surface 19*a*. As the rod 19 is progressively lowered in the direction of an arrow 22, the aluminum ball 10 inside the hollow protrusion 9 is subjected to deformation under the pressure supplied by the rod 19. FIG. 6 shows the final shape of the ball 10 that has been deformed when the ram 19 has been lowered down to its lowerest position. As shown, the head portion of the deformed ball 10 engages the shoulder 6*b* formed by the annularly stepped portion of the mounting hole of the finger grip. Thus, the finger grip 6 is solidly secured to the film base 2 by means of the deformed ball 10 engaging the shoulder 6*b*. FIG. 7 illustrates the finished film base partition 2 carrying the finger grip 6.

Figure 8:
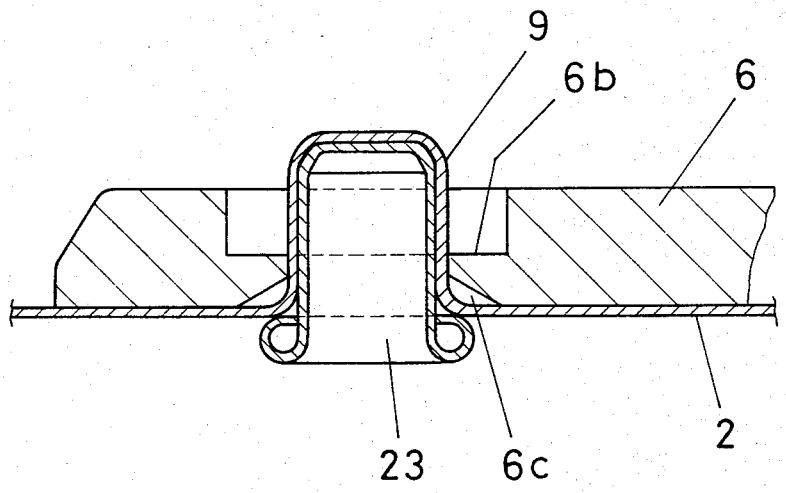
FIG. 8 is an enlarged sectional view illustrating a different partition construction to which a finger grip is being attached.
Figure 9:
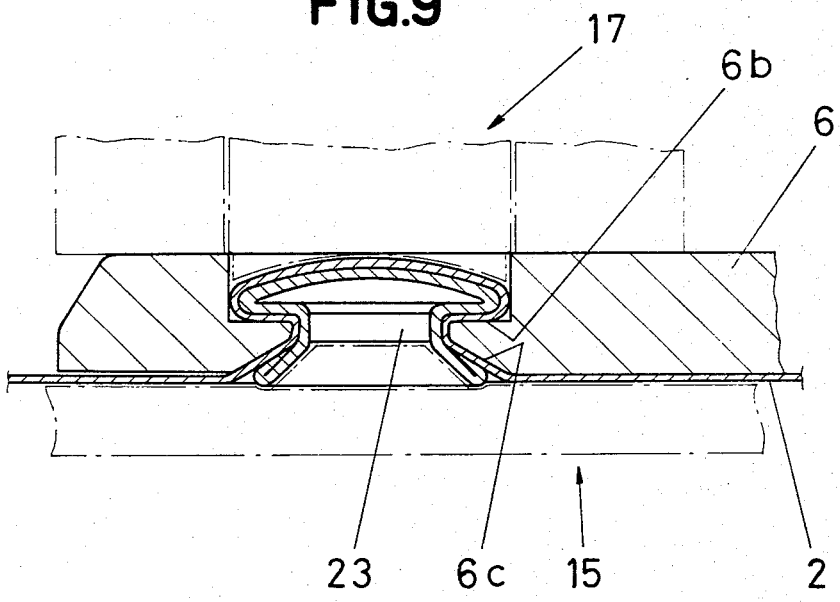
FIG. 9 is an enlarged sectional view of another different partition construction to which a finger grip has been attached.
Figure 10:
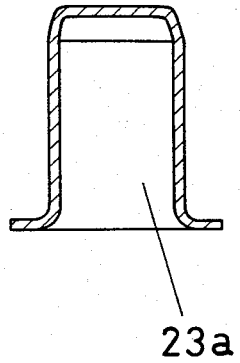
FIG. 10 through 13 are sectional views illustrating various forms of the filler member reinforcements to be provided inside the bulged portion of the partition.
Figure 11:
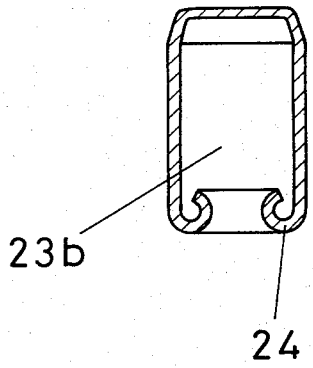
Figure 12:
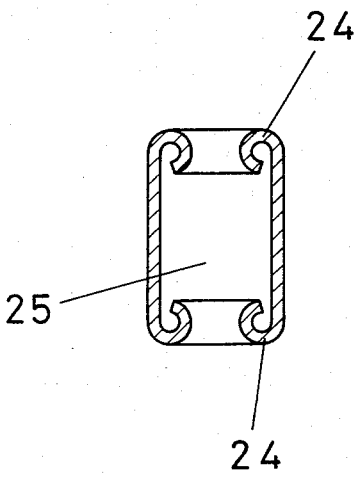
Figure 13:
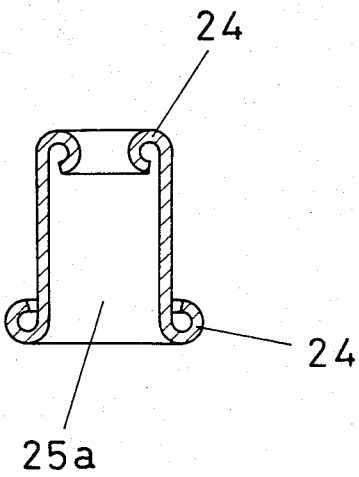
Figure 14:
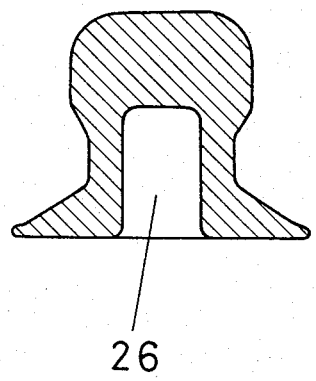
FIG. 14 is an enlarged sectional view of a different form of the filler member.
Figure 15:
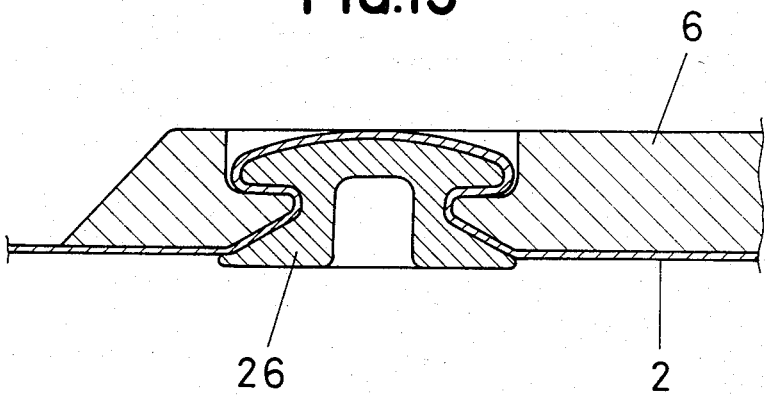
FIG. 15 is an enlarged sectional view illustrating how the finger grip is attached to the partition by means of another different form of the filler member.
Figure 16:
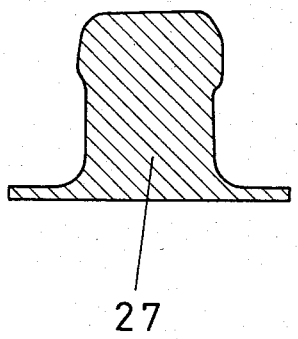
Figure 17:
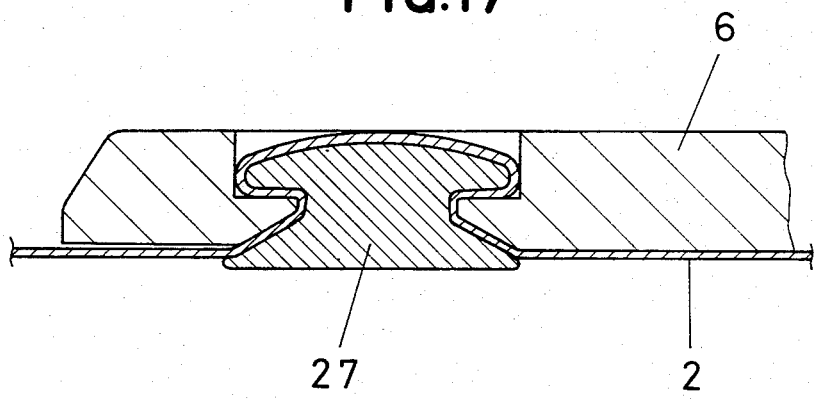

FIGS. 8 and 9 illustrate the different configuration of the reinforcing packing member backing the hollow protrusion 9. In this varied form of the embodiment, the packing or filler member is also made of aluminum, and has a cylindrical form 23 closed at the top. FIG. 9 show the finished shape of the packing member formed by the press assembly that consists of the upper and lower dies 17 and 15 like those used in the preceding embodiment. As shown in FIG. 9, the annular shoulder 6*b* of the mounting hole of the finger grip is tapered at the bottom with the thickness being progressively reduced toward the free end of the shoulder 6*b*. The tapered shoulder 6*b* is sandwiched by the deformed packing member including the identically deformed protruded portion 9 of the film base 2. This construction further strengthens the solidity of the finger grip to the partition. The cylindrically shaped packing member 23 may have various forms. For example, it may be formed like the shape shown in FIG. 10, in which the backing member 23*a* includes an outwardly extended flange at the bottom. FIG. 11 illustrates a different form of the packing member 23*b* including an curled flange 24 at the bottom. A differently configured packing member 25 as shown in FIG. 12 includes inwardly curled flanges 24 at the top and bottom. Another configuration of the packing member 25*a* shown in FIG. 13 includes an inwardly curled flange at the top and an outwardly curled flange at the bottom, both of which are designated by 24, FIG. 14 represents a configuration of the packing member formed like a cap (made of either metal or synthetic resin) as shown by 26, which is specifically designed to secure the finger grip to the partition base by means of the particularly formed packing member. FIG. 15 represents the finished shape of the same packing member. FIG. 16 illustrates the configuration of the packing member formed like a solid column 27 (made of metal or synthetic resin), and FIG. 17 shows the finally deformed shape of the same packing member. In the two variations shown in FIGS. 14 and 16, the packing members, which are made of synthetic resin, are required to be deformed by means of the shaping ram 17 which is heated.

Figure 18:
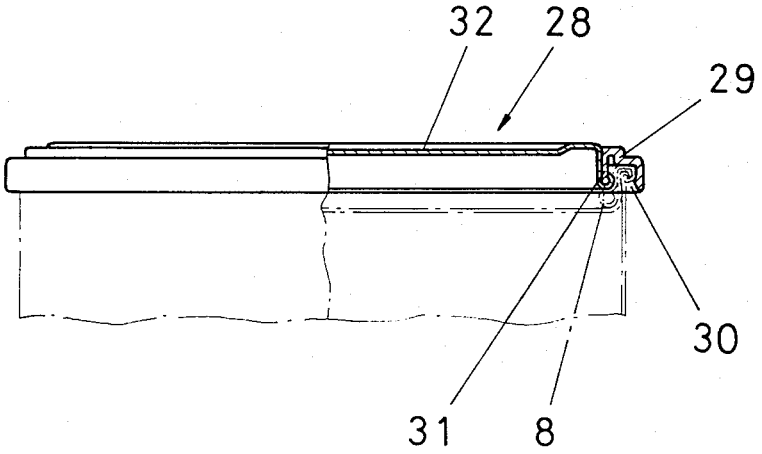
FIG. 18 and 19 illustrate the construction of different top covers to be capped over the open top of the can body.

The top cover 12 removably capping the open top of the can body may have various forms. FIG. 18 illustrates a first variation of th top cover, as designated by 28. The varied form of the top cover 28 includes a synthetic resin ring 29 which is configured differently from the top cover 13 described in the preceding embodiment, and a central metal end panel 32. In its specific configuration, the synthetic resin ring 29 of the top cover 28 includes an outer marginal flange 37 extending downwardly and an inner flange 31 also extending downwardly, the outer and inner flanges 37 and 31 defining an annular recess 30 which disengageably engage the peripheral seams formed around the open top of the can body 1. The central end panel 28 of the top cover has a marginal flange extending downwardly, and is combined with the synthetic resin ring 29 by bending the lower edge of the flange of the central end panel outwardly and securing it to the lower edge of the inner flange of the ring 29. With the top cover 28 constructed as described above, the connected edges of the central end panel 32 and synthetic resin ring 29 can engage the annular hollow portion 8 at the botton of the metal ring 7, while the annular recess 30 defined by the outer and inner flanges of the top cover can engage the seams of the can body. The combined action provided by the above two engagements improves the hermetic sealing of the can body.

In some cases, replacement of a gas originally contained in a can may be required depending on the kind of substances to be contained in the can. An alternative to the top cover constructions 28 shown in FIG. 18 is the construction shown in FIG. 19, which is specifically designed to make the gas replacement possible. The gas replacement usually takes place in the following sequence. After a substance such as powdered milk, fruit juice and the like is contained in a can, the bottom end plate 33 of the can body is temporarily seamed with the bottom marginal edge of the can body as designated by 24 (refer to FIG. 2). In this state, the can body is placed inside a gas replacement box (not shown). Initially, air is removed from the box, placing the interior of the box under vacuum, and then nitrogen gas or other replacement gas is introduced into the box, filling the interior of the can placed inside the box. In this case, the air contained in the space between the top cover and the intermediate partition (made of synthetic resin film 2 or metal foil) sealing the interior of the can body is placed in a hermetically sealed condition, which normally places that space under atmospheric pressure. Therefore, the space filled with the air is placed at a positive pressure with respect to the surrounding placed at vacuum outside the top cover, causing the metal end plate 32 of the top cover and the film base partition to expand outwardly. The above gas replacement sequence has been described for the top cover construction 28 shown in FIG. 18. In this sense, the top cover construcion 28 is not suited for the gas replacement processing, but it should be understood that the top cover 28 can serve as a seal for the contents that require no gas replacement.

Figure 19:
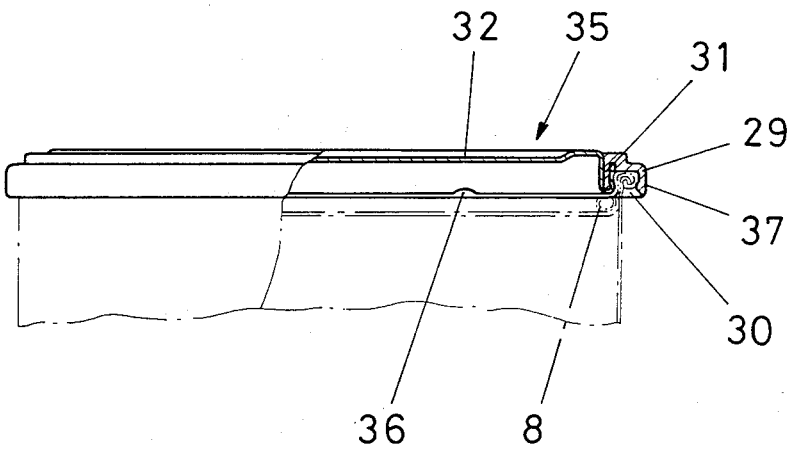

The top cover construction 35 shown in FIG. 19 is specifically designed to provide the sealing function when it is subjected to the gas replacement processing. In its particular form, the top cover 35 includes a vent gap 36 through which the air inside the cover 35 is to be escaped to the outside. As shown, the vent gap 36 is provided at a point of the top cover 35 where the bottom edge of the top cover 35 engages the annular hollow portion 8 of the metal ring 7 (the point where the bottom edge of the metal end panel 32 is connected to the inner flange 31 of the synthetic resin ring 29). For the top cover construction 34, the gas replacement sequence takes place as follows. Initially, the can body as it is capped by the top cover is placed inside the gas replacement box (not shown). This procedure is the same as for the top cover 28. That is, the interior of the box is placed under vaccum, allowing the air in the space between the metal end panel 32 and the film base partition to be relieved through the vent gap 36. The air escaping through the vent gap 36 is placed at a positive pressure with respect to the surrounding atmosphere inside the box applies pressure to the outer flange 37 of the synthetic resin ring 29 forming the annular recess 30 with the inner flange 31, forcing the outer flange 37 to be pushed outwardly so that it is opened to allow the air to flow therethrough into the box. Thus, the space delimited by the metal end panel and partition is placed at an equal pressure to the surrounding pressure inside the box. It is thus possible to avoid any undesired permanent deformation of the top cover 35 due to the presence of the positive pressure air inside the abve mentioned space. A nitrogen gas or the like is next introduced into the space for the purpose of the gas replacement. During this step of the processing, the space delimited by the end panel and partition is placed at a negative pressure with respect to the surrounding pressure. In effect, this allows the metal end panel 32 and partition to be deformed in the direction of bringing them closer to each other. Consequently, the outer flange 37 is opened wide by being subjected to outward deformation. Thus, a clearance is created between the annular recess 30 and the seam of the can body, through which the interior of the space communicates with the outside atmosphere inside the box. Through the vent clearance, the replacement gas is allowed to be introduced into the space. Thus, any undesired permanent deformation of the top cover and partition can be avoided.

The vent gap 36 provided on the bottom edge of the top cover has the form of a recess, but any other form such as a protrusion may be possible. Alternatively, a recess or protrusion or both may be formed in the area where the top cover engages the annular hollow portion 8. In any way, it is possible to employ any form of the vent gap as long as the vent gap allows the gas replacement effectively to take place.

The following is a detailed description of the semi-circular score or cut line 3 and straight score or cut line 4 to be provided on the film base partition 2. In the preceding embodiment, the non-score area 11 of a small width is provided between the opposite ends of the semi-circular score line 3 and the corresponding ends of the straight score line. The non-score area 11 is intended to provide a discontinuity of breakage between the two separate score lines 3 and 4 when the partition is to be detached. That is, when an attempt is made to detach the dispensing opening area of the partition which is delimited by the two score lines 3 and 4, the breakage of that area along the semi-circular score line 3 is stopped at the non-score area 11 for a moment, and then continues with the straight score line 4 separated by the non-score area 11 from the semi-circular score line 3. This permits an easy detachment of the dispensing opening area without damaging the cut edge of the straight score line 4, which serves as a scraper edge for a spoon.

Figure 20:
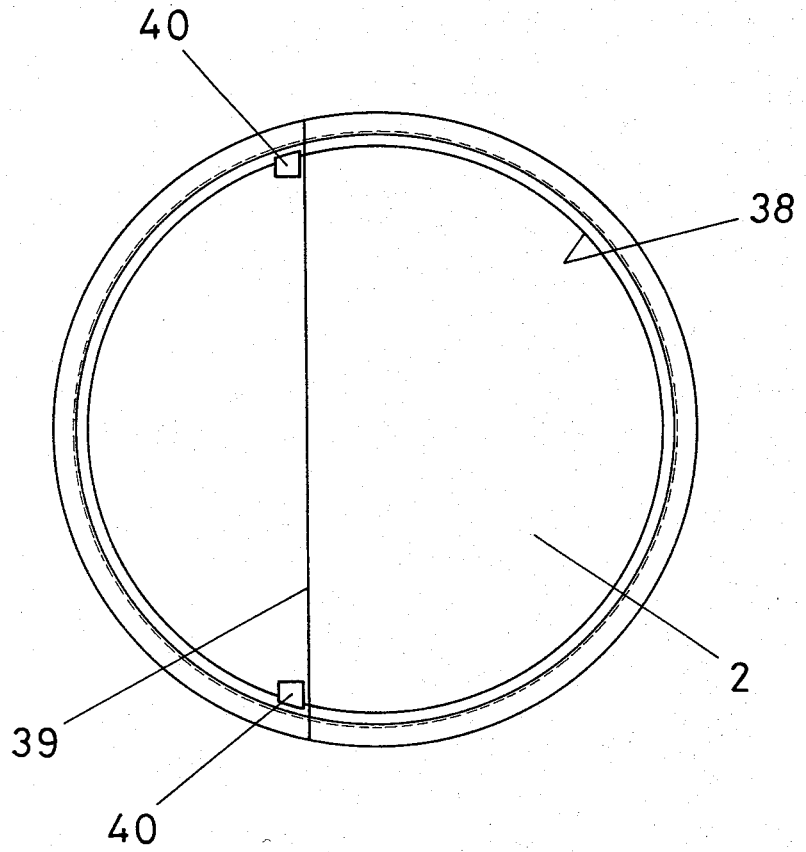
FIG. 20 is a plan view showing a variation of the partition.
Figure 21:
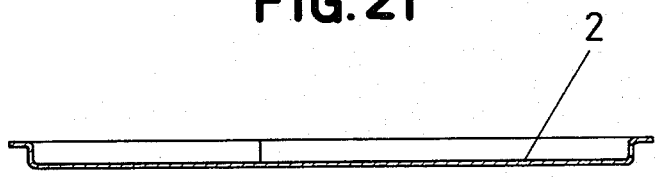
FIG. 21 is a sectional view of the same variation.
Figure 22:
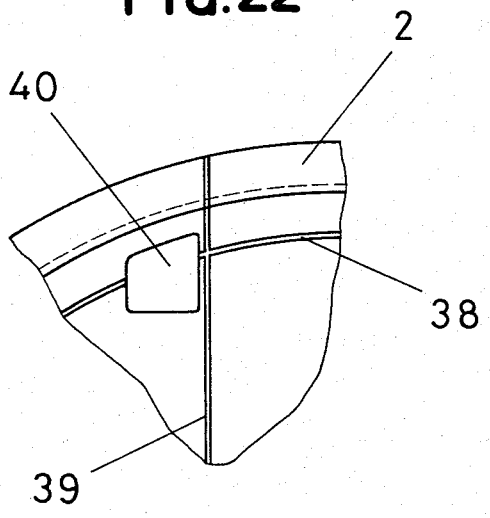
FIG. 22 is a partly enlarged plan view of the same partition.

FIGS. 20 and 22 illustrate a variation of the semicircular score line 3 in the preceding embodiment. As particularly shown in FIG. 20, an annular score line 38 is provided around the peripheral edge of the film base partition 2, and a straight score line 39 is provided across the partition such that the opposite ends of the straight score line 39 meet the annular score line 38. The area delimited by the two score lines 38 and 39 provides a semi-circular form dispensing opening area. In this case, the straight score line 39 provides a scraper edge after the dispensing opening area is completely detached. The annular score line 38 is broken at points where the straight score line 39 meets the annular score line 39. That is, a non-score area 40 is provided at each of the intersecting points of the two score lines 38 and 39, and each is located adjacent to the intersecting point and outside the dispensing opening area. This non-score area 40 in formed by fusing the film base by means of a heating tool, so that the score line at that area 40 can disappear. According to the varied embodiment particularly shown in FIG. 20, detachment of the dispensing opening area of the partition that is delimited by the two score lines 38 and 39 starts with cutting the semi-circular score line 38 and then continues with cutting the straight score line 39. In this case, the transition from the semi-circular score line 38 to the straight score line 39 can smoothly occur. After removal of the dispensing opening area, the edge of the remaining part of the partition running across the open top of the can body can be used as a scraper edge for a spoon, or may also be removed. This is accomplished by detaching the remaining part by cutting along the remaining score line 38.

Figure 23:
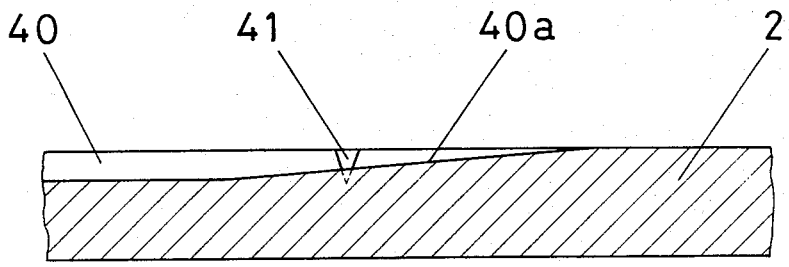
FIG. 23 is a partly enlarged sectional view of another varied form of the partition.

The configuration shown is FIG. 23 is a variation of the non-score area, which provides a function equivalent to the non-score area 11. As shown in FIG. 23, the film base partition 2 carries a semi-circular score line 40 along the peripheral edge thereof, the terminated end portions 40*a* of which are formed to provide a progressively smaller depth toward the terminated extremities of the score line 40. A straight score line 41 running across the partition 2 is provided in such a manner as to permit the opposite ends of the score line 40 to meet the corresponding terminated end portions 40*a* of the score line 40. The location of the intersecting point of the score lines may be either in the intermediate position or terminated extremity of the score line 40.

In the embodiment shown in FIG. 23, detachment of the dispensing opening area of the partition is initially done along the semi-circular score line 40, and then proceeds with the straight score line 41. Because of the presence of the terminated end portions 40*a* meeting the straight score line 41, however, the transition from the score line 40 to the score line 41 is stopped there for a moment.

The various embodiments of the constituent parts of the can according to the present invention have been described. As readily understood from the preceding description of those embodiments, the finger grip is solidly secured to the film base partition, and cannot be detached from th partition when an attempt is actually made to raise the finger grip for opening the can. Any form of the can that has been described may be used for containing substances such as powdered milk, fruit juice, and the like.

Although the present invention has been described with reference to the various embodiments thereof, it should be understood that various changes and modifications may be made without departing from the spirit and scope of the invention.

What is claimed is:

1. A can or similar container construction removably capped by a top cover having an intermediate film base partition detachably mounted over the open top of the can body, the partition carrying a peripheral score line and a straight score line across the partiton as well as a finger grip allowing the partition to be detached apart from the can body, comprising:

said finger grip having a mounting hole on one side acting as a pivotal or fulcrum point upon pulling the finger grip up from the other side thereof;

said intermediate film base partition having a hollow protrusion integrally formed thereon, for being inserted into said mounting hole; and a reinforcing metal packing member backing said hollow protrusion from the inside thereof, whereby said finger grip is solidly secured to the partition by inserting the reinforced hollow partition into said mounting hole of the finger grip and subjecting said reinforced hollow protrusion to deformation for engaging the mounting hole of the finger grip.

2. A can or similar container construction as defined in claim 1, wherein said reinforcing metal packing member is solid or hollow.

3. A can or similar container construction as defined in any of claims 1, 2 and 3, wherein the finger grip includes an annular stepped portion or shoulder of reduced diameter in the mounting hole thereof, and is solidly secured to the partition by sandwitching said shoulder between the reinforcing metal packing member and the film base partition.

4. A can or similar container construction as defined in claim 2, wherein said hollow reinforcing packing member has a cylindrical form closed or open at the top including a marginal bent flange.

* * * * *